United States Patent [19]

Wilson et al.

[11] 4,244,409

[45] Jan. 13, 1981

[54] COLLAPSIBLE SOLUTION CONTAINER

[75] Inventors: Thomas D. Wilson, Wyoming, Minn.; William G. Scott, Carpentersville, Ill.

[73] Assignee: Abbott Laboratories, North Chicago, Ill.

[21] Appl. No.: 83,003

[22] Filed: Oct. 9, 1979

[51] Int. Cl.[3] ..... B65D 1/02

[52] U.S. Cl. ..... 150/0.5; 222/107

[58] Field of Search ..... 150/0.5, 1, 8; 222/107; 128/214 D, 272, DIG. 24

[56] References Cited

U.S. PATENT DOCUMENTS

| | | | |
|---|---|---|---|
| 2,698,619 | 1/1955 | Beacham | 128/272 |
| 3,353,714 | 11/1967 | Trecek | 222/107 |
| 3,589,422 | 6/1971 | Bellamy | 128/DIG. 24 |
| 3,915,212 | 10/1975 | Bujan | 150/8 |
| 4,010,783 | 3/1977 | Ralston | 150/1 |
| 4,049,033 | 9/1977 | Ralston | 150/0.5 |
| 4,088,166 | 5/1978 | Miller | 150/0.5 |
| 4,090,541 | 5/1978 | Cammarata | 150/0.5 |
| 4,096,897 | 6/1978 | Cammarata | 150/0.5 |
| 4,100,953 | 7/1978 | Miller | 150/0.5 |
| 4,105,730 | 8/1978 | Cammarata | 264/89 |

*Primary Examiner*—Donald F. Norton

*Attorney, Agent, or Firm*—Robert L. Niblack; Neil E. Hamilton

[57] ABSTRACT

A collapsible container for medical fluids which is blow molded in such a manner that when the container is supported at one end, the side wall portions will automatically become self-pleating and will continue to assume a pleating condition toward the bottom of the container as the medical fluid is emptied therefrom. This self-pleating aspect is accomplished by blow molding the container in such a manner that the shoulder and side wall portions are of an average smaller dimension throughout the longitudinal axis of the body section and the shoulder portions join the side wall portions at an angle so as to effect a structurally weak point when the bag is supported by a hanger tab. This self-pleating phenomenon results in a container wherein the meniscus of the fluid is readily readable and accurately ascertained.

12 Claims, 10 Drawing Figures

FIG. 1
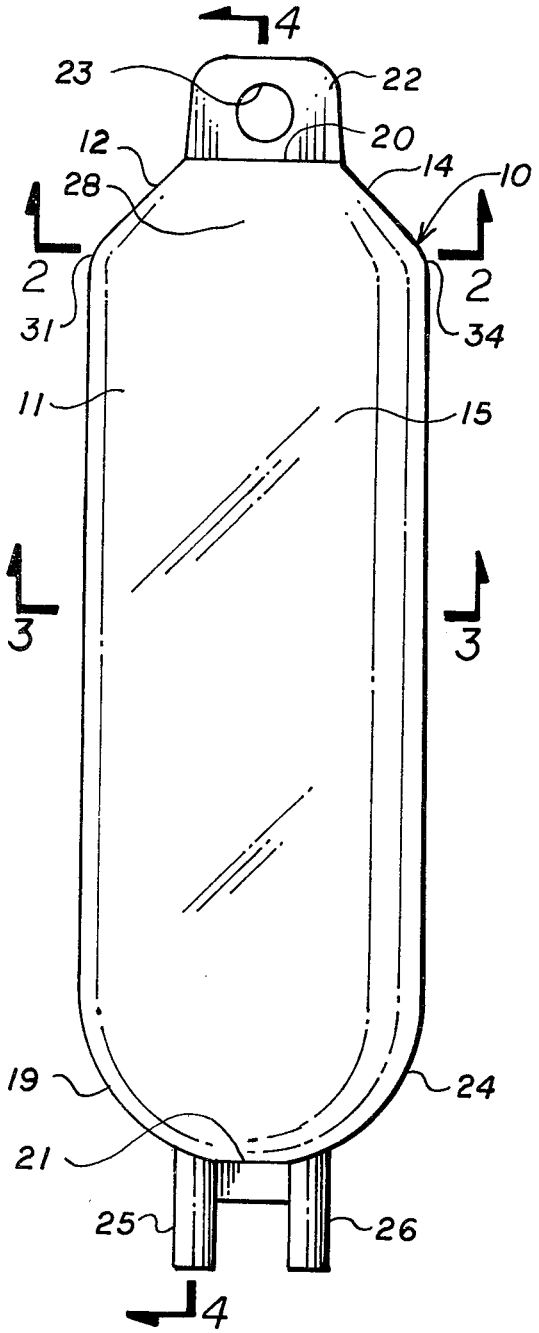
FIG. 4
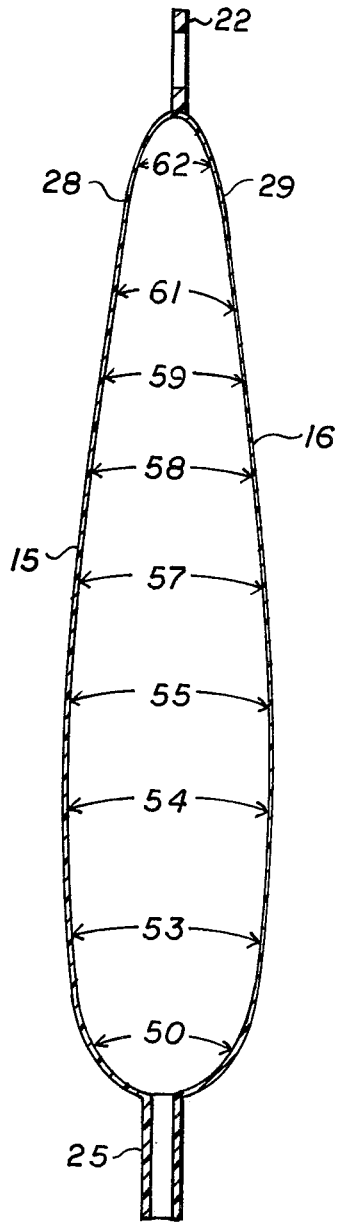
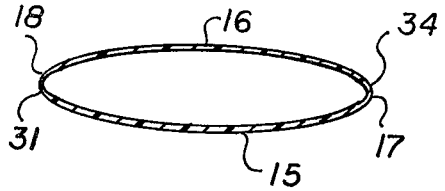
FIG. 2
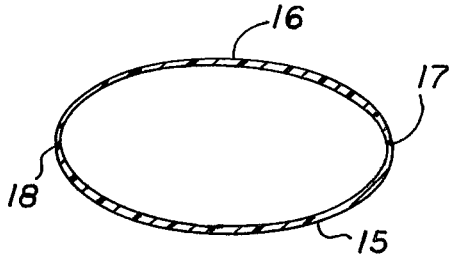
FIG. 3

COLLAPSIBLE SOLUTION CONTAINER

BACKGROUND OF THE INVENTION

This invention relates to a flexible and disposable plastic bag for containing and administering medical fluids. More particularly, the invention relates to a plastic container for intravenous fluid which is blow molded in a manner such that when the contents of the bag are administered the bag will collapse in a uniform manner with opposing pleats in the side wall portions to thereby provide for accurate dispensing and determination of the bag contents.

The problems confronting the dispensing of medical fluids from flexible plastic bags are alluded to in U.S. Pat. No. 3,915,212. As indicated therein, because of the flexible nature of the bag, the bag can become distorted during emptying making it difficult to read the meniscus which is necessary to determine the amount of fluid being administered. Also as indicated in U.S. Pat. No. 4,049,033, incomplete collapse of the container can be due to the stiffness of the thin walled container which effects a resistance to collapse and a consequent moderate vacuum exerted to the container. To remedy these problems, a container is proposed in U.S. Pat. No. 3,915,212 utilizing a bag which is sealed at its edges and has a hanger portion at one end which hanger portion is reinforced to prevent uneven collapse. In U.S. Pat. No. 4,049,033, added elements are utilized in conjunction with a blow mold bag such as external shoulder portions, opposing flat end sections and gussets so as to effect a uniform collapse of a solution container.

Other versions of a blow molded, collapsible solution container are described in U.S. Pat. Nos. 4,010,783; 4,088,166; 4,090,541; 4,096,897; 4,100,953 and 4,105,730. All of the previously mentioned patents provide for the molding into the body section of the bag such features are gussets, rigid neck and shoulder portions, transverse lines of weakness, recesses and rods in the tail or hanger section of the bags to provide for gradual container collapse as the contents are dispensed.

The prior art is concerned with the molding of additional elements or features to a flexible bag in order to effect controlled collapsing. This adds to the cost of the bag and in many instances does not provide for controlled and uniform collapse of the bag walls.

It is an advantage of the present invention to provide a flexible bag for medical fluids wherein the bag walls will collapse in a manner during administration of the fluid so that accurate administration can be determined. Other advantages are a plastic solution container which can be blow molded so as to produce a bag at a minimum cost; a solution container which by controlling the wall thicknesses in a predetermined manner will result in a solution container wherein the walls will uniformly collapse during emptying; and a solution container which does not require additional elements or stiffening members to be provided in the bag structure so as to afford accurate determination of the bag contents.

SUMMARY OF THE INVENTION

The foregoing advantages are accomplished and the shortcomings of the prior art are overcome by the flexible, collapsible container for medical fluids as presented herein which is composed of a flexible, inert plastic material. The body section of the container is of a generally flat tubular configuration when empty and has a longitudinal axis and a transverse axis shorter than the longitudinal axis. The body section when filled with medical fluid will have a generally transverse oval configuration with the body section further defining front, back, side and opposing end wall portions, all of which are substantially smooth and unencumbered. The end wall portions provide a hanger section at one end and tubular passageways extend from the opposite end with the side wall portions tapering in a uniform manner from the outermost maximum dimension of the body section of the end wall portions. The body section is blow molded from a plastic resinous material so that the thickness of the side wall portions throughout the longitudinal axis are of an average smaller dimension than the front and back wall portions and the shoulder portions join the side wall portions and the hanger end wall at an angle so as to effect a structurally weak point when the bag is supported by a hanger tab. When the container is filled with medical fluid and supported by the hanger section and the medical fluid allowed to flow through an opposing tubular passageway, the side wall portions in the body section adjacent the hanger section end and defining shoulder portions will assume an opposing pleated configuration with the pleated configuration continuing to be formed longitudinally along the body section in the side wall portions and in the direction of the tubular passageway as the medical fluid is drained from the container. In one embodiment, the hanger section further includes an outwardly extending flat tab portion which is of a dimension less than one-half of the widest transverse axis of the body section when in an empty or flat condition. Preferably, the thickness of the side wall portions range from 0.0105" to 0.0232" whereas the thickness of the front and back wall portions range from 0.0107" to 0.0367". In a preferred manner the thickness of the wall portions forming the shoulder portions is in the range of about 0.0110" to about 0.0232" with the front and back wall portions having a width which increases from the center of the wall in the direction of the hanger section and with the smallest width being at the center of the front and back wall portions.

BRIEF DESCRIPTION OF THE DRAWINGS

A better understanding of the flexible, collapsible container of this invention will be had by reference to the following description together with the accompanying drawings, wherein:

FIG. 1 is a view in side elevation showing the container of this invention in a condition as it would be molded.

FIG. 2 is a view in horizontal section taken along line 2—2 of FIG. 1.

FIG. 3 is a view in horizontal section taken along line 3—3 of FIG. 1.

FIG. 4 is a view in vertical section taken along line 4—4 of FIG. 1.

DESCRIPTION OF AN EMBODIMENT

Figure 5:
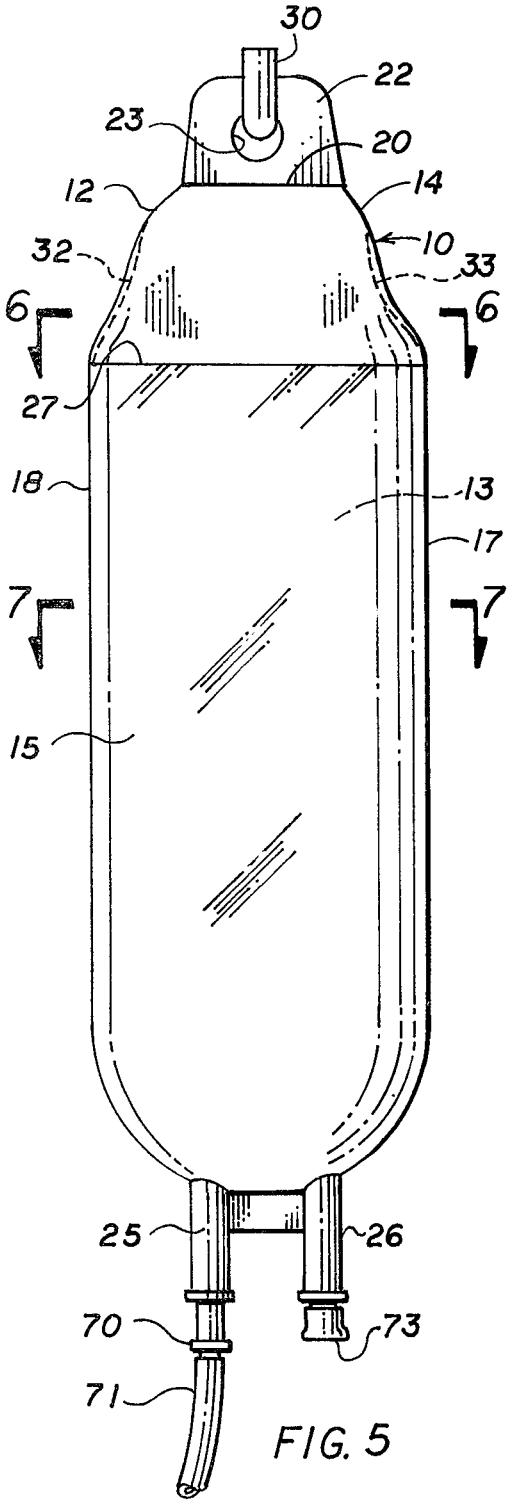
FIG. 5 is a view in side elevation illustrating the supported container with fluid during administration of some of the fluid.

Referring to FIG. 1 of the drawing, flexible container 10 includes a tubular body section 11 having a front wall 15 which at one end terminates in end wall 20 from which centrally extends a flat hanger tab 22 with an aperture 23. Extending from the opposing end is another end wall 21 through which extend two tubular passageways 25 and 26 in fluid communication with the inside of container 10.

Figure 7:
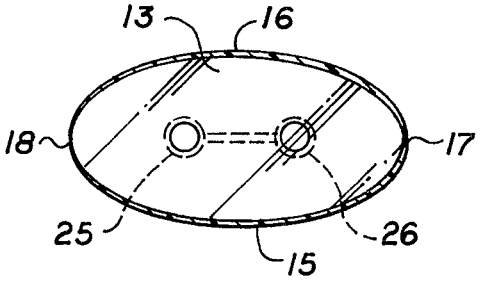
FIG. 7 is a view in horizontal section taken along line 7—7 of FIG. 5.

As best seen in FIGS. 2, 3 and 7, bag 10 when filled with a medical fluid 13 such as saline solution will by nature of its configuration assume a generally transverse oval configuration providing side wall portions 17 and 18 and front and back wall portions 15 and 16. As indicated in FIGS. 2 and 3, the transverse cross section of bag 10 through the center thereof is of a greater dimension than when viewed through a cross section taken along line 2—2 of FIG. 1. This is due to the fact that the bag has tapered end wall sections 28 and 29 (See FIG. 4) and shoulder portions 12 and 14 and extending from the widest dimension and narrowing down to their juncture with end wall 20 and hanger tab 22. Base portions 19 and 24 extend in a somewhat similar manner from the opposite end of the bag from its widest width to end wall 21 except rather than being somewhat straight sided as in the case of shoulders 12 and 14, base portions 19 and 24 assume a curved configuration.

It will be noted in conjunction with FIGS. 2 and 3, that side walls 17 and 18 have a thinner width or dimension than front and back walls 15 and 16. In the case of side walls 17 and 18, a preferred wall thickness would be in the range of 0.0105 inch to 0.0232 inch. For the front and back walls, a preferred wall thickness is in the range of 0.0107 inch to about 0.0367 inch. The width of side wall portions 17 and 18 in the area of shoulder portions 12 and 14 is in the range of 0.0110 inch to 0.0232 inch. These dimensions are relative and can vary.

FIG. 4 shows a profile of the wall width from top to bottom of the front and back wall sections. The various wall thicknesses are indicated by the specific arrow numbers as follows:

TABLE

| Arrow Number | Wall Width (Inch) |
|---|---|
| 50 | .0248 |
| 53 | .0260 |
| 54 | .0270 |
| 55 | .0227 |
| 57 | .0163 |
| 58 | .0189 |
| 59 | .0295 |
| 61 | .0357 |
| 62 | .0367 |

It will be seen from the foregoing profile that the wall thickness of walls 15 and 16 increases from port 25 toward the center of the bag where the width becomes thinner and reaches its minimum width. From the center of the bag the wall width again increases as it approaches hanger tab 22.

Figure 6:
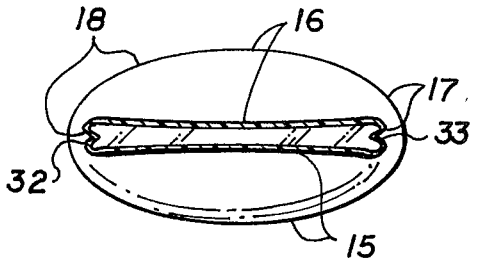
FIG. 6 is a view in horizontal section taken along line 6—6 of FIG. 5.

FIG. 5 illustrates the condition of bag 10 when the contents 13 are administered such as by the standard piercing pin 70 and tubing 71 connected to the usual drip chamber and venipuncture device. A reseal cap 73 is secured over tubular port 26 for purposes of adding medicinal materials to bag 10 which is supported by means of a support 30 engaging aperture 23. It will be seen that as the liquid level designed by meniscus 27 begins to descend in bag 10, the side walls 17 and 18 will by nature of the thinner wall thickness in the shoulder portions 12 and 14 automatically assume a somewhat U-shaped pleat configuration such as indicated by the numerals 32 and 33. This is best seen in FIG. 6. Continued automatic pleating is effected by means of the thinner wall sections at side walls 17 and 18 and dimensioning of the hanger tab 22 such that its width is substantially less than the widest width of body section 11 as well as providing the front and back wall portions 15 and 16 with the thinnest dimension at the center and increasing the wall width as it approaches hanger tab 22.

Figure 8:
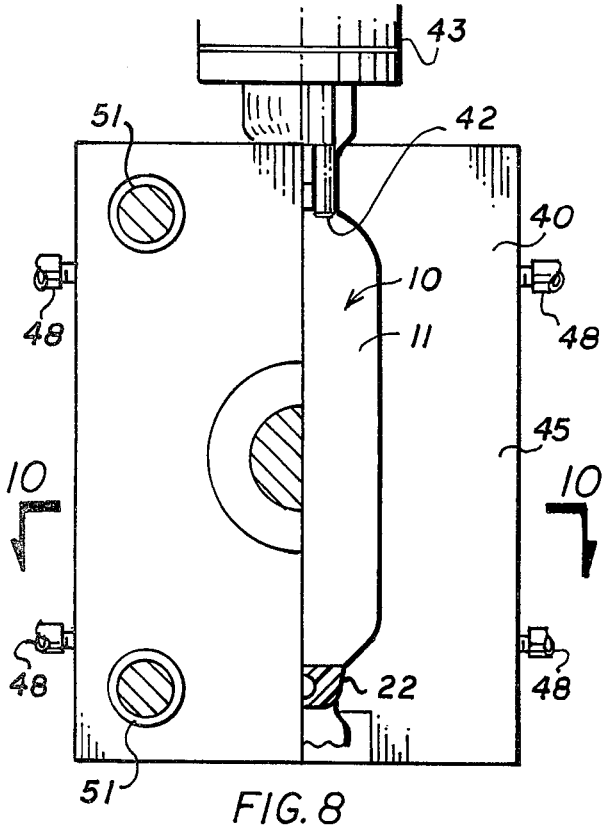
FIG. 8 is a view in side elevation illustrating the blow molding procedure for forming the bag of this invention with half of the mold being broken away to show the container as formed in the mold.
Figure 9:
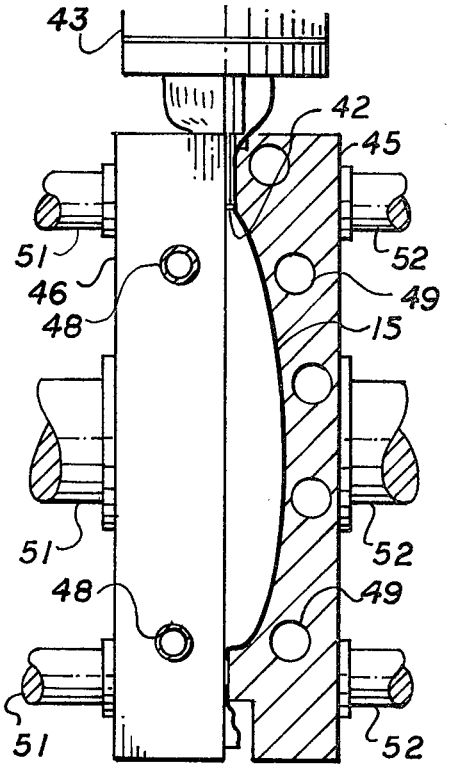
FIG. 9 is a view taken 90° from that shown in FIG. 8 and also with half of the mold broken away illustrating the molding of the container in the mold.
Figure 10:
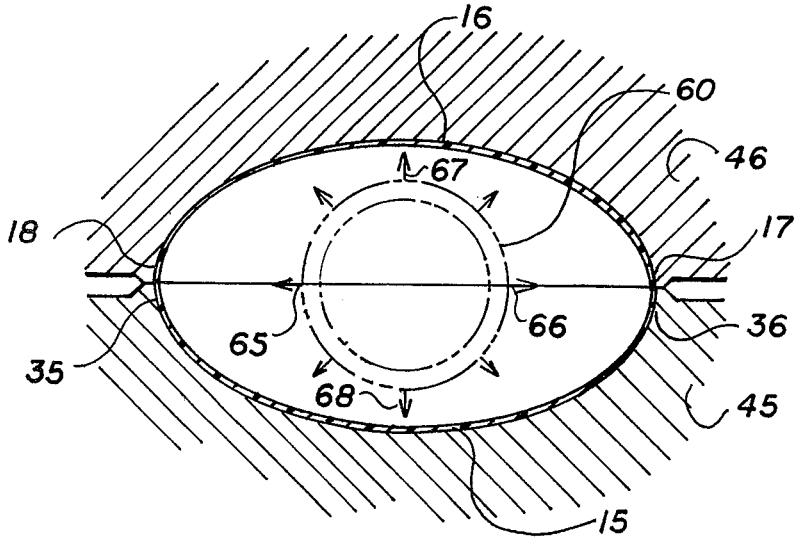
FIG. 10 is a view in horizontal section taken along line 10—10 of FIG. 8.

FIGS. 8, 9 and 10 illustrate the blow molding operation for molding bag 10. As is customary, a parison 60 will first be extruded and after it reaches a predetermined length will be surrounded by mold halves 45 and 46 of mold 40. When positioned between the mold halves, a blow pin 42 will be inserted from blow pin head 43 and air will be introduced into the parison in order to expand the parison to the mold cavity which will result in body section 11 and the opposing hanger tab 22 and tubular passageways 25 and 26. While only one blow pin 42 is indicated in FIG. 8, it will be appreciated that two such pins will actually be employed and will result in the formation of passageways 25 and 26. As will be appreciated, the usual cooling pipes 48 with interconnecting cooling passageways 49 in the molds will be utilized so as to cool the parison. Rods 51 and 52 are for the purpose of bringing the mold halves together and apart.

In order to accomplish the previously described self-pleating of container 10 as the medical fluid is drained therefrom, the thickness of the side walls 17 and 18 must be accurately controlled as well as the average larger wall thickness of front walls 15 and 16. It will be appreciated that the parison is of a cylindrical configuration in addition to having the thinnest portion at the center of the mold. Accordingly, when the parison is blown into contact with the mold, as best shown in FIG. 10, those portions of the cylindrical parison adjacent mold side walls 35 and 36 will then become elliptical and will have thinner sections at the side walls as the parison material must stretch further in order to cover the walls of the mold. This is indicated by arrows 65, 66 and results in the side walls 17 and 18 having an average thinner dimension than the front and back walls 15 and 16 where the parison 60 will stretch a shorter distance as shown by arrows 67 and 68. It will be appreciated that this thinning of the side walls will also be accomplished in the shoulder portions 12 and 14 as the parison will have to stretch to contact the curved outer surfaces of the mold forming the shoulder portions.

It will be appreciated that in the fabrication of a collapsible solution container it is not only desirable that the contents of the container evacuate completely without the introduction of outside air, but that this evacuation be accomplished with a minimum of air in the container at the beginning. The desired collapse is one in which the solution presents a clearly defined and linearly falling meniscus such as 27. These features are accomplished in the present container design through the phenomenon found in blown containers with a particular geometric shape which enables an inward folding or pleating of the container. The phenomenon is that of thinning of the wall thickness such as side walls 17, 18 and shoulders 12 and 14 of a basically oval container and joining the shoulders 12 and 14 with the side walls at an angle to effect weakened corners 31 and 34, respectively. This in effect creates a weakening through the side walls 17 and 18 and in particular through the hanger section of the bag surrounded by shoulders 12 and 14. The weakening is also aided in that the bag by having a medical fluid therein must be sterilized and that this is accomplished by heat sterilization. Due to the stress placed on the inwardly disposed hanger tab 22 which joins shoulders 12 and 14 at an angle and the weight of the material in the container 10 in combination with the thinner wall sections of shoulders 12 and 14, the automatic inward folding of the container as indicated by pleats 32 and 33 is effected beginning at the corners 31 and 34 which will be at the most structurally weakened part of the bag. This is accomplished with a minimum amount of head space which in effect will drive the solution down because the head space is of a smaller area at the top due to the constant tucking in of the container. The paneling off in effect of the container walls is well above the meniscus 27 of the dropping fluid so that a clearly readable meniscus is effected. While heat sterilization is an added benefit in accomplishing the preweakening of the wall sections in the area of the shoulders 12 and 14, plastic formulating could also effect the same purpose.

The preferred resin for blow molding container 10 is polyvinylchloride. However, other resins such as polypropylene or polyethylene could be employed. It should also be pointed out that while container 10 as described herein is of a size to accommodate 1 liter of fluid, other sizes which are standard in the industry are readily employed and can range from 3 liters to 250 ml.

It will thus be seen that through the present invention there is provided a blow molded flexible container for I.V. or medical fluids which has a minimum number of parts yet is collapsible to provide a well defined meniscus. The container of the invention can be molded from standard blow molding equipment which by molding the walls and shoulders of the container will allow automatic pleating of the side walls during administration of the contents. All of the foregoing is accomplished in a container which can be molded in a manner which does not result in increased costs and, as the wall widths are thinner than a standard I.V. or medical fluid container, result in an inexpensive container.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. A flexible, collapsible container for medical fluids composed of a flexible, inert, plastic material, said container comprising:

a body section of generally flat tubular configuration when empty having a longitudinal axis and a transverse axis shorter than said longitudinal axis, said body section when filled with said medical fluid having a generally transverse oval configuration, said body section further defining front, back, side and opposing side wall portions which are substantially smooth and unencumbered within the confines of said body section, said end wall portions defining a hanger section at one end and a tubular passageway extending from the opposing end, the side wall portions at said one end of said body section tapering in a uniform manner from the outermost dimension of the body section to said hanger section to define shoulder portions with weakened corners between said outermost dimensions at said hanger section, said body section being blow molded from a plastic resinous material with the thickness of the shoulder portions and the side wall portions throughout the longitudinal axis being of a smaller dimension than the front and back wall portions, so that when said container is filled with said medical fluid and supported by said hanger section and the medical fluid is allowed to flow from the opposing tubular passageway, at least one of the side wall portions in the body section adjacent the corners of said hanger section end will assume an opposing inwardly extending pleated configuration which pleated configuration will continue to be formed longitudinally along the body section in the direction of the tubular passageway as the medical fluid is continued to be drained from said container.

2. The flexible, collapsible container as defined in claim 1 wherein the shoulder portions are of a straight sided configuration and the side walls extending to the end wall with the tubular passageway are of a rounded configuration.

3. The flexible, collapsible container as defined in claim 1 wherein said hanger section further includes a substantially flat tab portion extending from said one end wall portion.

4. The flexible, collapsible container as defined in claim 3 wherein said shoulder portions join said flat tab portion at an angle.

5. The flexible, collapsible container as defined in claim 3 wherein two said tubular passageways extend from the end wall portion opposite the hanger section.

6. The flexible, collapsible container as defined in claim 5 wherein said plastic resinous material is polyvinylchloride.

7. The flexible, collapsible container as defined in claim 6 wherein said hanger tab and said two tubular passageways are centrally positioned from said body section of said container.

8. The flexible, collapsible container as defined in claim 1 wherein the thickness of said side wall portions is in the range of about 0.0105 inch to about 0.0232 inch and the thickness of the front and back wall portion is in the range of about 0.0107 inch to about 0.0367 inch.

9. The flexible, collapsible container as defined in claim 8 wherein the thickness of the side wall portions forming the shoulder portions is in the range of about 0.0110 inch to about 0.0232 inch.

10. The flexible, collapsible container as defined in claim 8 wherein said front and back wall portions have a wall thickness which increases from the center of the wall in the direction of the hanger section.

11. The flexible, collapsible container as defined in claim 10 wherein said front and back wall portions have a wall thickness which when taken along a median line from the end wall portions has its smallest width at the center of the body section.

12. The flexible, collapsible container as defined in claim 1 wherein said blow molding is effected by a blow pin positioned in a cavity mold having a tubular passage which ultimately forms said tubular passageway.

* * * * *

UNITED STATES PATENT AND TRADEMARK OFFICE

CERTIFICATE OF CORRECTION

PATENT NO. : 4,244,409

DATED : January 13, 1981

INVENTOR(S) : Thomas D. Wilson, William G. Scott

It is certified that error appears in the above—identified patent and that said Letters Patent is hereby corrected as shown below:

Claim 1, Column 5, line 67 should read and opposing end wall portions which are substan- Signed and Sealed this

*Twenty-fifth* Day of *May 1982*

[SEAL]

*Attest:*

GERALD J. MOSSINGHOFF

*Attesting Officer*

*Commissioner of Patents and Trademarks*